United States Patent [19]

Frieber

[11] 4,306,538

[45] Dec. 22, 1981

[54] AUTOMATIC AIR INLET CONTROL

[76] Inventor: Robert A. Frieber, P.O. Box 6212, Bridgewater, N.J. 08807

[21] Appl. No.: 134,188

[22] Filed: Mar. 26, 1980

[51] Int. Cl.[3] ..... F23L 3/00

[52] U.S. Cl. ..... 126/290; 126/77

[58] Field of Search ..... 126/15 R, 77, 285 R, 126/289, 290, 292

[56] References Cited

U.S. PATENT DOCUMENTS 2,370,891 3/1945 Thornquist ..... 126/77

FOREIGN PATENT DOCUMENTS 9898A of 1889 United Kingdom ..... 126/285 R

*Primary Examiner*—Carroll B. Dority, Jr.
*Attorney, Agent, or Firm*—Daniel H. Bobis

[57] ABSTRACT

An automatic air inlet control for combustion devices having an inlet for combustion air and a discharge outlet or flue will include, an elongated tubular member defining a flow passage having an inlet and an outlet, the outlet end of the tubular member being connected to the combustion air inlet for said combustion device. A fulcrum member connected to the tubular member adjacent the inlet end has a pivotal section disposed a predetermined spaced distance forward of the transverse vertical plane of said inlet end for pivotally supporting a damper assembly thereon, said damper assembly having a cover plate with a diameter greater than the diameter of said inlet end of the tubular member and further provided with a knife edge section for mounting the damper assembly in the pivotal section of the fulcrum, and a counter weight balancing assembly connected to the cover plate so as to depend therefrom in assembled position on the side of the pivotal section remote from the cover plate so as to normally balance the damper assembly to open position. A governor assembly to limit the opening movement of the damper assembly to provide a predetermined maximum flow of combustion air through said automatic air inlet control.

The automatic air inlet control as above described having means to coact with the pivot section of the fulcrum member so as to adjust the relative distance of the edge of the cover plate remote from the fulcrum member so as to abet the regulation of the predetermined minimum air flow through the automatic air inlet control when the damper assembly is in the closed position.

6 Claims, 12 Drawing Figures

AUTOMATIC AIR INLET CONTROL

BACKGROUND OF THE INVENTION

This invention relates generally to combustion devices such as stoves and furnaces for burning wood and more particularly to an automatic air inlet control to control the flow of combustion air into the combustion chamber of said combustion devices so as to reduce and limit the heat losses incident to the flow of hot air and hot combustion gases from the combustion device.

Stoves and other combustion devices generally include a combustion chamber therein which has at least one air inlet for combustion air and a discharge outlet or flue for hot air and hot combustion gases. These devices may have some air leakage or may be substantially air tight. However, even where some air leakage occurs, the greater portion of the air to support combustion enters through the combustion air inlet and conventionally some form of control device will be provided to control the flow of combustion air into the combustion chamber of the stove or like combustion device.

Those skilled in the art will readily recognize that as the rate of combustion increases, that the pressure of the draft caused by the flow of hot air and hot combustion gases through the discharge outlet or flue will also increase thereby causing a pressure drop in the combustion chamber of the given stove or like combustion device. This in turn tends to increase the flow of combustion air into the combustion chamber producing a corresponding increase in combustion in the combustion device. If this increased combustion is not controlled by providing a combustion air inlet control, the fuel which is generally wood in devices of this type, will be rapidly consumed and extensive heat losses will occur due to the waste heat which passes with the increased flow of hot air and hot combustion gases out of the combustion device through the discharge outlet or flue therefore.

If the combustion air inlet control is of the manual type, then it is obvious that the combustion will have to be manitored carefully and this will require the time and effort of a person in the vicinity of the stove or like combustion device.

In the prior art various types of combustion air inlet control devices have been developed as is shown in U.S. Pat. Nos. 1,286,489, 1,626,228, 2,232,981, 2,424,154, and 4,174,941.

In some instances other types of draft controls have been developed which act to cool the temperature of the hot air and hot combustion gases passing through the discharge outlet or flue for the combustion device as is shown in U.S. Pat. Nos. 218,596, 687,483, 1,783,418 and 1,822,321.

Where the control device is associated with the discharge outlet or flue for the combustion device, it cannot act to limit or reduce the waste heat lost in the system but merely dampens the rate of combustion in the combustion chamber of the given combustion device.

The present invention seeks to provide a relatively simple and cheap automatic air inlet control which is responsive to the pressure in the combustion chamber of the stove or like combustion device so that the air inlet control acts immediately to reduce the combustion air delivered to the combustion chamber to a predetermined minimum flow whenever increase in combustion produces a correspondingly large increase of flow in the hot air and hot combustion gases passing through the discharge outlet or flue for the combustion device. Conversely the air inlet control in accordance with the present invention will also act immediately to move to full open position when combustion air is needed to maintain combustion of the wood or other fuel in the combustion chamber of the combustion device as a function of the decrease in the flow of hot air and hot combustion gases through the discharge or flue for the combustion device.

This is accomplished in the present device by means of an elongated tubular member which is connected about the combustion air inlet for the combustion device to define an air intake flow passage therethrough in turn controlled by a damper assembly at the inlet end of the elongated tubular member which is movable from a substantially closed position wherein a predetermined minimum flow of combustion air occurs to a predetermined maximum position so as to deliver combustion air for maintaining combustion of the wood or other fuel in the combustion chamber of the combustion device.

SUMMARY OF THE INVENTION

Thus the present invention covers an automatic air inlet control for stoves and the like combustion devices having a combustion air inlet and a discharge outlet comprising, an elongated tubular member defining an air flow passage therethrough having an inlet at one end and an outlet at the opposite end, connecting means at the outlet end for connecting said elongated tubular member about the combustion air inlet for the combustion device, fulcrum means connected to the tubular member at the inlet end having a pivot section disposed a predetermined spaced distance forward of the plane of the inlet end of the tubular member, and a damper assembly having, a cover plate with a diameter greater than the diameter for the inlet end of the tubular member and a knife edge section for pivotally mounting the damper assembly on the pivot section of the fulcrum means, counterweight balancing means connected to the cover plate so as to depend therefrom on the side of the pivot section remote from the cover plate to normally balance said damper assembly to open position, and said damper assembly movable to closed position to substantially occlude the inlet end of the tubular member whereby a predetermined minimum air flow will pass through the automatic air inlet control, and a governor means to limit the opening movement of said automatic air inlet control to provide a predetermined maximum flow of air through said automatic air inlet control to the combustion air inlet of the combustion device.

The automatic air inlet control as above defined including, means coacting with said pivot section of the fulcrum means to adjust the predetermined minimum air flow entering said flow passage in the elongated tubular member when the damper assembly substantially occludes the inlet end of said tubular member.

Accordingly, it is an object of the present invention to provide a relatively simple and low cost automatic air inlet control for a combustion device to reduce and limit the waste heat lost from said combustion device with the hot air and hot combustion gases discharged therefrom.

It is another object of the present invention to provide an automatic air inlet control disposed in the closed position so as to permit a predetermined minimum flow of air to enter through the automatic air inlet control and into the associated combustion device.

Other objects and advantages of the invention including the basic design and the nature of the improvements thereon will appear from the following description taken in conjunction with the accompanying drawings, in which:

DESCRIPTION OF A PREFERRED EMBODIMENT OF THE INVENTION

Figure 1:
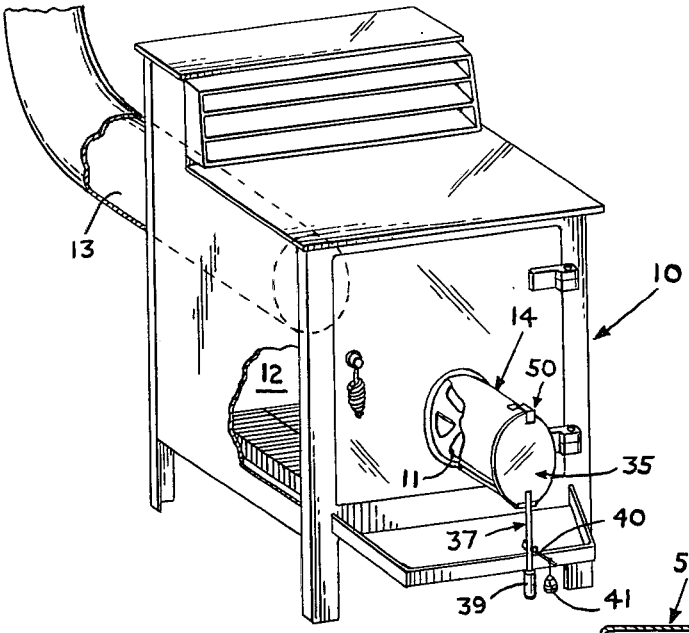
FIG. 1 is a perspective view of a combustion device partly in section having one form of automatic air inlet control thereon in accordance with the present invention.

Referring to the drawings FIG. 1 shows one type of wood burning stove or combustion device designated 10 which is used for heating purposes.

Stoves or combustion devices for burning wood and other fuels are well known in the prior art and generally may have some air leakage or may be substantially air tight. However the greater portion of the air to support combustion enters through an air inlet 11 which communicates with the combustion chamber 12 in the combustion device. After combustion occurs in the combustion chamber, hot air and hot combustion gases will flow from the combustion chamber through a discharge outlet or flue 13 which communicates with the atmosphere.

Since the hot air and hot combustion gases which discharge through the discharge outlet or flue 13 for the combustion device carry with them waste heat, a substantial amount of the potential heat content of the wood or other fuel being used in the combustion chamber of the combustion device can be lost if the rate of flow of the hot air and hot combustion gases through the discharge outlet or flue 13 is not controlled.

In the present invention this problem is overcome by providing an automatic air inlet control generally designated 14 for the combustion air to be delivered through the combustion air inlet 11 to the combustion chamber 12 for the combustion device 10 which automatic air inlet control will now be described.

AUTOMATIC AIR INLET CONTROL

Thus, referring to FIGS. 2 to 6 of the drawings, the automatic air inlet control 14 is shown as including an elongated tubular member 15 which defines a flow passage 16 having an inlet as at 17 and an outlet as at 18.

The outlet end of the tubular member 14 is connected to the combustion air inlet 11 for the combustion device 10 by means of a connecting bracket 19 which is a V-shaped strap pivotally connected as at 20 and 21 to the inner wall of the elongated tubular member 15. Connecting bracket 19 has a center portion 22 for this purpose as it includes an opening as at 23 which can be fitted with a threaded member 24 into the spider support 25 in the combustion air inlet 11 of the tubular member 15 as by the threaded nut 26 so as to hold the tubular member 15 into assembled position about the combustion air inlet 11 as is clearly shown in FIGS. 1 and 3 of the drawings.

The structure as above described is designed so as not to require any physical reconstruction of the combustion air inlet other than the removal of the conventional manually operated draft control device and thus makes use of the standard attaching devices for the associated stove as provided by the manufacturer for their draft control device. This eliminates the need for extensive cutting or special tools and simplifies attaching the automatic air inlet control in accordance with the present invention into its assembled and operating position.

Bracket 19, will also be pivoted to allow for slight misalignment of the opening 23 with respect to the corresponding opening 27 in the spider 25 to facilitate connecting the automatic air inlet control 14 into assembled position about the combustion air inlet for the stove or combustion device 10.

The spider 25 will have a plurality of spaced openings as at 28 so that combustion air admitted into the elongated tubular member 15 will be able to pass freely through the combustion air inlet 11 into the combustion chamber 12 of the stove or combustion device 10.

Figure 2:
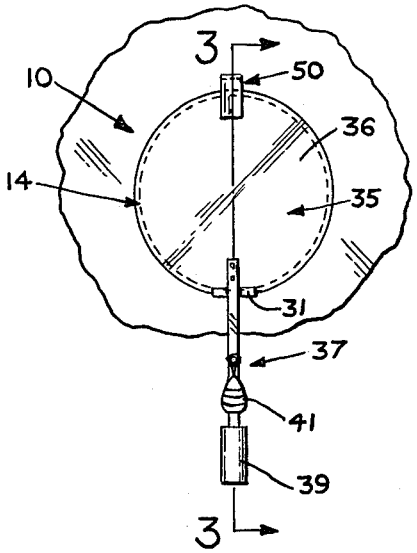
FIG. 2 is a front view of the automatic air inlet control shown in FIG. 1.
Figure 2A:
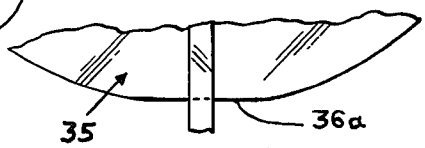
FIG. 2*a* is a fragmentary view of the knife edge section formed at the lower edge of the cover plate for pivotally mounting the damper assembly of the automatic air inlet control shown in FIG. 1.
Figure 3:
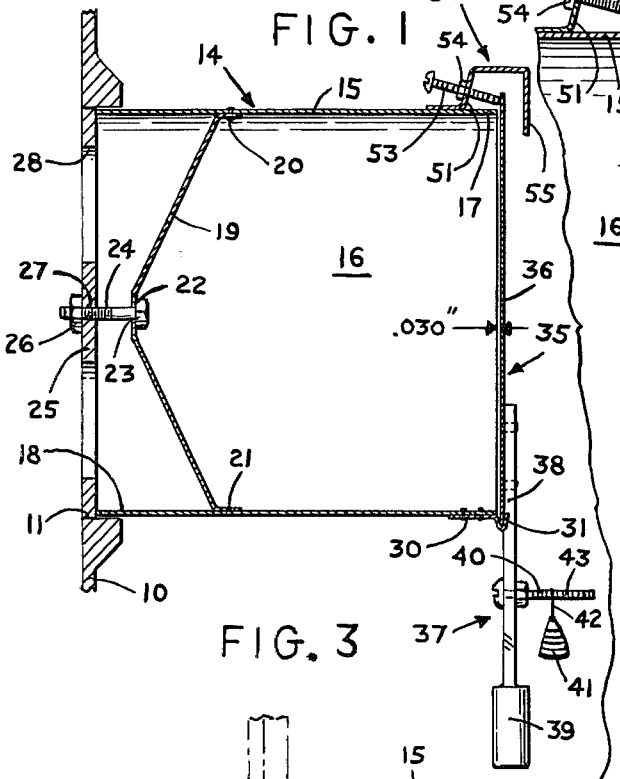
FIG. 3 is a vertical section taken on line 3—3 of FIG. 2 showing the automatic air inlet control in the closed position.
Figure 3B:
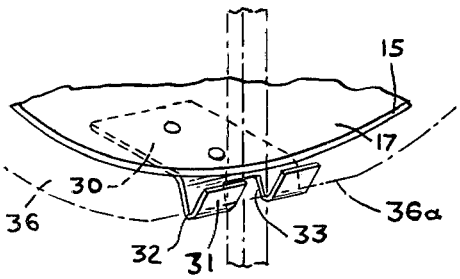
FIG. 3*b* is a perspective fragmentary view of the pivot section on the fulcrum member with the connecting rod of the counter weight balancing assembly of the damper assembly shown in phantomized form in assembled position.

At the inlet 17 end of the elongated tubular member 15 opposite from the end connected about the combustion air inlet 11 for the combustion device 10 a fulcrum member 30 is fixedly connected to the lowermost portion of the outer wall of the tubular member 15 substantially in the vertical plane of the longitudinal axis thereof as will be clear by reference to FIGS. 1, 2 and 3 of the drawings.

Fulcrum member 30 will be fixedly connected as by welding or any other suitable means to the tubular member 15 so that a V-shaped pivot section 31 thereon will lie just below the outer periphery of the tubular member substantially normal to the longitudinal axis and at a predetermined spaced distance in front or forward of the transverse vertical plane of the inlet 17 which is also normal to the longitudinal axis of the tubular member 15.

The V-shaped pivot section 31 has a pivot or fulcrum 32 and a medially disposed opening or space 33 thereon which also lies in the longitudinal axis of the tubular member 15 for reasons that will be clear from the description of the pivotal mounting of the damper assembly more fully set forth below.

This position of the pivot section 31 of the fulcrum member 30 is important because it will provide a predetermined clearance between the inlet 17 and the damper assembly generally designated 35 to be described more fully below which is pivotally mounted on the fulcrum member 30 and the inlet end of the elongated member 15 to insure a predetermined minimum flow of combustion air into the combustion chamber 12 of the stove or combustion device 10 to which the automatic air control 14 in accordance with the present invention is connected.

It has been determined that an optimum spacing for the pivot section forward of the inlet end of the tubular member 15 in the order of 0.030" will provide the desired predetermined minimum flow of combustion air for the combustion chamber of any stove or combustion device.

A predetermined minimum flow of combustion air is desirable to reduce condensation of creasote and other complex hydrocarbons on the inner walls of the automatic air inlet control, the walls of the combustion chamber 12 and the discharge outlet or flue 13 therefore, such condensation products being a dangerous fire hazard and also acting as an insulator to prevent heat from radiating properly from the stove or combustion device 10 to the space which such device may be heating.

DAMPER ASSEMBLY

The damper assembly 35 acts automatically responsive to changes of the pressure in the combustion space 12 of the stove or combustion device 10.

Damper assembly 35 has a cover plate 36 and a counterweight balancing assembly 37 is connected to the outer face of the cover plate 36 so that in assembled position it will depend from the cover plate 36 and will lie in the longitudinal axis of the elongated tubular member 15 on the side opposite from the axis of rotation about which the damper assembly 35 will pivot in assembled position on the fulcrum member 30 as is shown in FIGS. 1, 2, 3*a* and 4 of the drawings.

FIGS. 1 to 4 further show that in order to pivotally mount the damper assembly 35, the cover plate 36 is cut or formed to provide a knife edge section as at 36*a* which knife edge section 36*a* is sufficiently long to fit into the pivot or fulcrum 32 and to span the space 33 on the pivot section 31 of the fulcrum member 30.

In this assembled position a rod element 38 on the counter weight balancing assembly 37 can extend past the space or opening 32 in the pivot section 31 of the fulcrum member downwardly below the pivot section 31 supporting the damper assembly 35 to a fixed weight member 39 which provides an initial balancing adjustment for the damper assembly 30.

While a weight member 39 is shown it is obvious that the rod 38 could be made sufficiently heavy to provide the required balancing adjustment for the damper assembly 30.

It is often necessary and desirable to adjust the center of gravity of the damper assembly 35 to more finely balance the same in assembled position. For this purpose the counterweight balancing assembly 37 is provided with a forward projecting bar 40 connected by any suitable means in the longitudinal axis of the tubular member 15 medially along the rod element 38 between the pivot or fulcrum 33 and the fixed weight member 39.

To obtain the fine adjustment a sized and movable weight 41 is hung by means of a loop or annular bracket 42 at any desired or given position in at least one of a plurality of grooves as at 43 provided on the rod element 38. The adjustable weight 41 can be moved to and fro along the rod element 40 as may be necessary in adjusting the center of gravity and the balance of the damper assembly 35 when it is mounted for pivotal movement in the fulcrum 30.

FIGS. 1 to 6 also show that the automatic air inlet control in accordance with the present invention has a governor 50 which is fixedly connected in the longitudinal axis of the tubular member 15 as by welding or any suitable means to the outer wall thereof adjacent the inlet end and in alignment with the fulcrum member 30 on the diametrically opposite side of the tubular member 15.

Figure 3A:
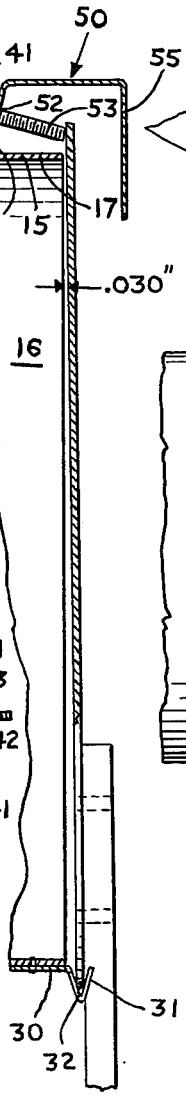
FIG. 3*a* is an enlarged view showing the operative relation in the closed position of the cover plate of the damper assembly to the inlet end of the tubular member of the automatic air inlet control shown in FIG. 3.
Figure 4:
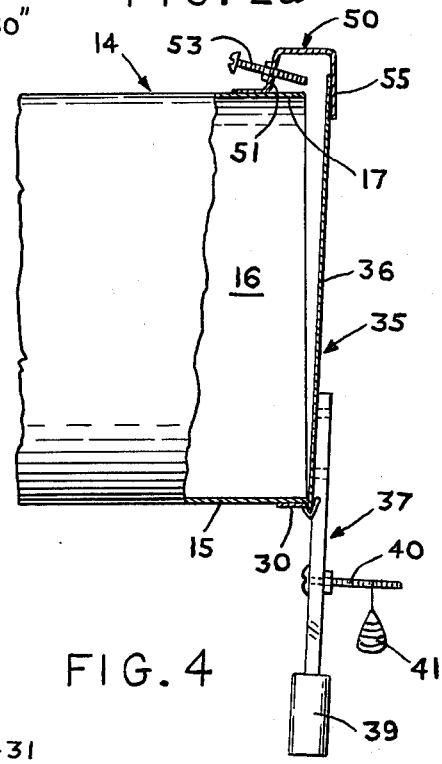
FIG. 4 is a vertical section of just the inlet end of the automatic air inlet control identical to that as shown in FIG. 3 only showing the damper assembly of the automatic air inlet control in the open position.
Figure 5:
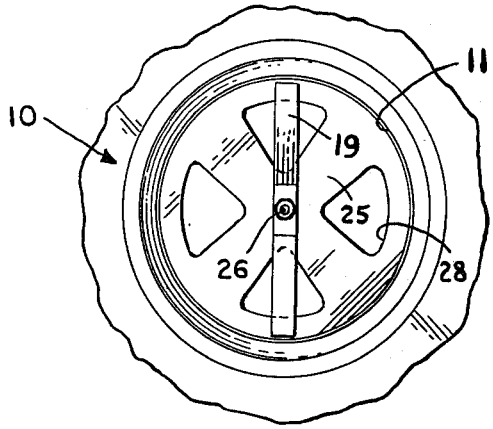
FIG. 5 is a view of the combustion air inlet for the combustion device showing the discharge or outlet end of the automatic air inlet control connected in assembled position.
Figure 6:
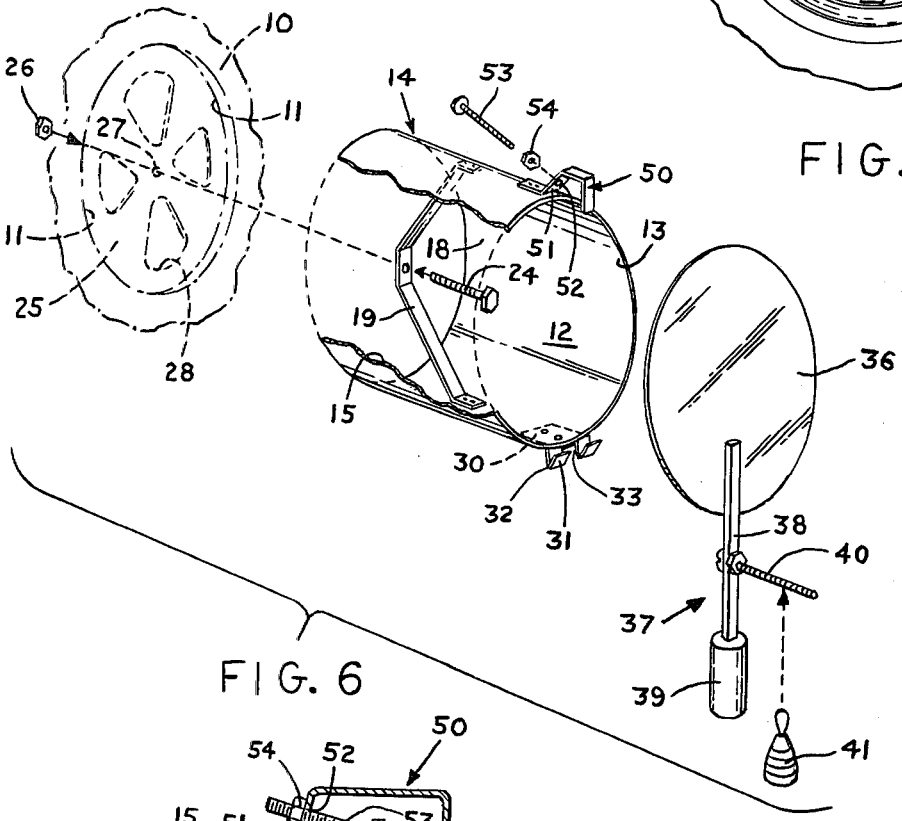
FIG. 6 is an exploded view of the elements of the automatic air inlet control shown in FIG. 1.

The governor 50 is a convoluted member having a portion 51 angled at an angle of about 45° in which a threaded opening 52 receives a threaded member 53 threadable into and out of engagement with the inner face of the cover plate 36 to adjustably position the end of the cover plate remote from the pivot section 32 on the fulcrum 30 so as to aid and abet the desired predetermined minimum clearance between the inner face of the cover plate 36 and the inlet opening 17 on the tubular member 15 so as to provide the predetermined minimum flow of combustion air into the combustion device 10 when the damper assembly 35 is in the closed or occluded position as is shown in FIGS. 3 and 3*a* of the drawings. A locking member 54 is used to hold the threaded member 53 in its adjusted position.

The governor also includes a stop shoulder section as at 55 which extends out and over the cover plate 36 to form a stop so that when the damper assembly moves to open position as is hereinafter described, the opening movement is limited by the stop section 55 of the governor 50.

INSTALLATION AND OPERATION

After the automatic air inlet control 14 is connected to the combustion air inlet 11 on the combustion device 10, the forwardly projecting rod 40 is positioned on the elongated rod 38 of the counterweight balancing assembly 37. Then the damper assembly 35 is mounted by the knife edge section 37 in the pivot or fulcrum 32 of the pivot section 31 of the fulcrum member 30 in the manner illustrated at FIGS. 3, 3*a* and *b* of the drawings.

In this position the top of the cover plate should be able to pivot freely between the inlet end 17 of the tubular member 15 and the stop 55 of the governor 50. Holding the damper assembly 35 in the closed or occluded position the governor screw 53 is threaded until it just touches the inner face of the cover plate 36 which extends beyond the outer surface of the tubular member 16 is shown clearly at FIG. 3*a* of the drawings.

The damper screw 53 is now threaded approximately one-half turn more so as to establish a slight opening between the cover plate and the inlet end 17 of the tubular member 15 of approximately 0.030" in this closed position. In order to maintain this setting the locking nut 54 is turned to lock the threaded screw 53 in its adjusted position.

The adjusting weight 41 which hangs on the balance rod or arm 40 and is movable along the length thereof is used to vary the heat output from the combustion device 10. For lower heat output the weight is moved in closer to the counterweight balancing rod 38 and for high heat output it is moved further away from the counterweight balancing rod. Those skilled in the art will understand that each combustion device 10 varies and that the adjusting weight 41 therefore can be sized heavier or lighter as may be required to deliver a full range of heat output for the given combustion device.

If creasote or other deposits form in the automatic air inlet control, this should be removed and the clearance adjusted to increase the predetermined minimum flow through the automatic air inlet control when the damper is in the closed position.

In operation when the damper assembly is connected as above described it will normally balance into the open position to permit combustion to proceed freely in the combustion chamber 12 of the combustion device 10.

Whenever combustion so increases that the hot air and hot combustion gases are delivered at a rate to produce a pressure drop in the combustion chamber 12, the reduction in pressure will act to move the damper assembly into the closed or occluded position so as to control and optimize the rate of combustion in the combustion chamber 12 and to minimize the loss of waste heat in the hot air and hot combustion gases which pass through the discharge outlet or flue 13 of the combustion device.

The automatic air inlet control will work best on those combustion devices in which air leaks to provide combustion air other then through the combustion air inlet 11 of the combustion device are minimized or preferably eliminated. If necessary to achieve this the combustion device 10 should be treated with suitable non-flamable cements or fire proofed asbestos cord to seal such air leaks and this will insure proper operation of the automatic air inlet control in accordance with the present invention.

Thus a relatively simple and low cost automatic air inlet control for reducing and conserving waste heat normally lost in wood burning stoves or similar combustion devices.

ALTERNATE EMBODIMENT

Figure 7:
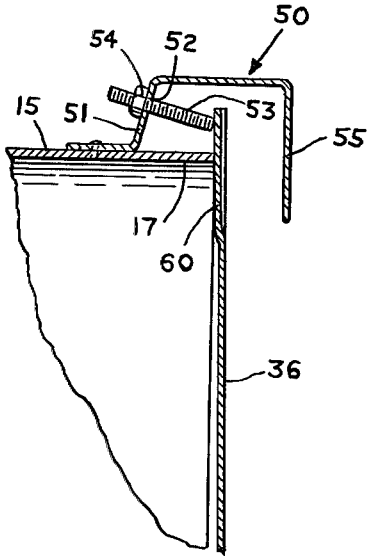
FIG. 7 is a vertical section showing an alternate form of cover plate for an automatic air inlet control in accordance with the invention.
Figure 7A:
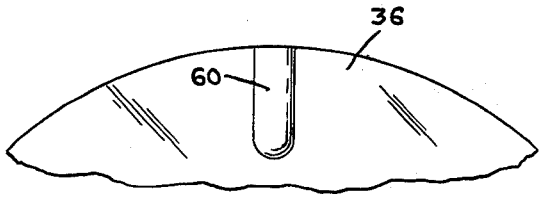
FIG. 7*a* is a back plan view of the uppermost end of the cover plate for the alternate form of cover plate shown in FIG. 7.
Figure 7B:
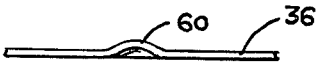
FIG. 7*b* is a top plan view of a fragment of the uppermost end of the alternate form of cover plate shown in FIG. 7.

FIGS. 7, 7*a* and 7*b* show an alternate embodiment of the present invention in which the cover plate 36 has an inwardly shaped extending projection 60 formed at the upper end thereof which is disposed to engage the inlet end of the tubular member when the damper assembly 35 is pivotally mounted in the pivot section 31 of the fulcrum means 30.

The shaped inwardly extending projection 60 lies about 0.5" in from the edge of the cover plate and is raised from the surface of the cover plate about 0.030" along its length. Projection 60 together with the forwardly extending section 33 will insure a predetermined minimum clearance between the inner wall of the cover plate and the end of the inlet end 17 of the tubular member 15 when the damper assembly moves to closed position.

This predetermined minimum clearance will be in a range from 0.030" to 0.050" and any additional clearances that may be required can be obtained by adjusting the governor screw 53 as above described.

This form of the invention will be installed and will operate in the same manner as was described for the form of the invention shown in FIGS. 1 to 6 of the drawings.

It will be understood that the invention is not to be limited to the specific construction or arrangement of parts shown but that they may be widely modified within the invention defined by the claims.

What is claimed is:

1. An automatic air inlet control for stoves and the like combustion devices having a combustion air inlet and a discharge outlet thereon, comprising, a. an elongated tubular member defining an air flow passage therethrough having an inlet at one end and at outlet at the opposite end, b. connecting means for connecting the outlet end of said tubular member to said stove about the combustion air inlet thereon to pass combustion air to the combustion air inlet for said stove, c. fulcrum means connected to the lower section of said tubular member having, a pivot section thereon extending a predetermined spaced distance forward of the plane of the inlet end of said tubular member, d. damper assembly means including, a cover plate having a diameter greater than the diameter of the inlet end of said tubular member, and counterweight balancing means operatively connected to the cover plate, e. said damper assembly means pivotally connected to said pivot section of the fulcrum means to permit said damper assembly means to pivot from open to closed position relative the inlet end of the tubular member as a function of the increase and decrease of pressure in the combustion device, and said damper assembly means disposed to provide a predetermined minimum air flow through said automatic air inlet control in the closed position, and f. governor means connected adjacent the inlet end of the tubular member at the upper end thereof for limiting the opening movement of said damper assembly.

2. In the automatic air inlet control as claimed in claim 1 including at least one adjustable weight means operatively connected to the counterweight balancing assembly to vary the center of gravity of said damper assembly whereby the amount of force required to move the damper assembly to closed position can be increased and decreased by varying the various weight means connected to the counterweight balancing assembly.

3. In an automatic draft control as claimed in claim 1 wherein, a. the lower end of said cover plate is formed with a knife edge section, b. said cover plate having the knife edge section disposed to rest in said pivot section of the fulcrum means for pivotally mounting the damper assembly means relative the inlet end of the tubular member, and c. means to adjustably position the cover plate to adjust the predetermined clearance between the inner face of the cover plate and the inlet end of the tubular member.

4. In an automatic air inlet control as claimed in claim 1 wherein, a. said fulcrum means is connected to the tubular member transverse to the longitudinal axis thereof, and b. the governor means is connected to the upper end of the tubular member in alignment but diametrically opposed relative the fulcrum means and in the longitudinal axis of the tubular member, c. and the damper assembly is disposed to fit between the fulcrum means and the governor means so that the cover plate thereon can move towards and away from the inlet end of the tubular member from open to closed position and vice versa.

5. In an automatic air inlet control as claimed in claim 4 including, threaded means for adjusting the end of the cover plate remote from the pivoted end to regulate the clearance between the inner face of the cover plate and the end of the tubular member.

6. In an automatic air inlet control as claimed in claim 1 wherein the cover plate has a raised inwardly extending section thereon remote from the pivotally connected end of the damper assembly means, said raised section adapted to contact the inlet end of the tubular member for operative association with the pivot section of the fulcrum means to regulate the predetermined minimum flow when the damper assembly means is in the closed position.

* * * * *